US009828156B2

(12) United States Patent
McKenzie

(10) Patent No.: US 9,828,156 B2
(45) Date of Patent: Nov. 28, 2017

(54) PACKAGING

(71) Applicant: British American Tobacco (Investments) Limited, London (GB)

(72) Inventor: Aaron McKenzie, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 148 days.

(21) Appl. No.: 14/377,593

(22) PCT Filed: Feb. 7, 2013

(86) PCT No.: PCT/EP2013/052405

§ 371 (c)(1),
(2) Date: Aug. 8, 2014

(87) PCT Pub. No.: WO2013/120756

PCT Pub. Date: Aug. 22, 2013

(65) Prior Publication Data

US 2015/0021218 A1 Jan. 22, 2015

(30) Foreign Application Priority Data

Feb. 15, 2012 (GB) ..... 1202565.6

(51) Int. Cl.

| | |
|---|---|
| ***B65D 85/10*** | (2006.01) |
| ***B65D 75/58*** | (2006.01) |
| ***B31B 50/81*** | (2017.01) |

(52) U.S. Cl.

CPC ..... *B65D 75/5844* (2013.01); *B31B 50/81* (2017.08); *B65D 85/1045* (2013.01); *B65D 85/1054* (2013.01); *B65D 2203/12* (2013.01)

(58) Field of Classification Search

CPC ..... B65D 75/5844; B65D 75/5827; B65D 75/5833; B65D 75/5838; B31B 1/14; B31B 1/90

USPC ..... 206/242, 245, 259, 265, 268, 271, 274, 206/275

See application file for complete search history.

(56) References Cited

U.S. PATENT DOCUMENTS 5,065,868 A * 11/1991 Cornelissen ..... B65D 33/02 206/440
7,150,802 B2 12/2006 Pinchen
2003/0116614 A1 6/2003 Block et al.
(Continued)

FOREIGN PATENT DOCUMENTS

CN 1322180 11/2011
GB 2319511 5/1998
(Continued)

OTHER PUBLICATIONS

International Seraching Authority; Written Opinion of the International Searching Authority; dated May 13, 2013; NL.
(Continued)

*Primary Examiner* — Steven A. Reynolds
*Assistant Examiner* — Javier A Pagan
(74) *Attorney, Agent, or Firm* — Cantor Colburn LLP

(57) ABSTRACT

Packaging including a line of weakness (10, 11) that is broken to obtain access to an article within said packaging is disclosed. A varnish or lacquer coating is applied to spaced regions (12) along the length of the line of weakness.

12 Claims, 5 Drawing Sheets

(56) References Cited

U.S. PATENT DOCUMENTS

| | | | | |
|---|---|---|---|---|
| 2010/0221469 | A1* | 9/2010 | Mills | B65D 75/5844 428/35.5 |
| 2011/0000802 | A1* | 1/2011 | Weiss | B65D 5/4212 206/242 |
| 2011/0177268 | A1* | 7/2011 | Fresnel | B29C 61/0608 428/34.9 |

FOREIGN PATENT DOCUMENTS

| | | |
|---|---|---|
| GB | 2364018 | 6/2000 |
| JP | 2011184077 | 9/2011 |
| WO | 2009034377 | 3/2009 |
| WO | 2011001200 | 1/2011 |

OTHER PUBLICATIONS

International Preliminary Examining Authority; Notification of Transmittal of the International Preliminary Report on Patentability; dated Jan. 24, 2014; Munich.

CN Office Action dated Feb. 27, 2017 re: Applicaton No. 201380009639X; pp. 1-7; citing: CN101835696A and U.S. Pat. No. 5,068,568A.

* cited by examiner

PACKAGING

CROSS REFERENCE TO PRIOR APPLICATION

This application is a national stage application filing under 35 U.S.C. §371 of and claims benefit under 35 USC §365(c) to PCT/EP2013/052405, filed on Feb. 7, 2013, which claims priority to and benefit of European Patent Application No. 1202565.6, filed on Feb. 15, 2012.

TECHNICAL FIELD

This invention relates to packaging and to a method of manufacturing packaging.

BACKGROUND

Some types of packaging often have a line of weakness, such as a line of perforations or a tear strip to facilitate opening of the packaging to gain access to the contents of the packaging. The line of weakness or tear strip may be formed directly in that part of the packaging that directly surrounds and contains the contents and which may be formed from a polymer film, paper or card. Alternatively, that part of the packaging that directly surrounds the contents may include an overwrap, such as a cellophane film that extends over it and seals and/or protects the contents against moisture or contamination. As the line of weakness is broken or torn to enable access to the contents of the packaging, it also provides an indication as to whether the packaging has been previously opened.

Packaging of the aforementioned type is often used to contain a bundle of smoking articles. A pack of smoking articles may be provided with a removable overwrap, such as cellophane, which may be provided with a pull tab to enable the overwrap to be removed so that the pack can be opened.

SUMMARY

In accordance with embodiments of the invention, there is provided packaging including a line of weakness that is broken to obtain access to within said packaging, wherein a varnish or lacquer coating is applied to spaced regions along the length of the line of weakness.

In preferred embodiments, the varnish or lacquer coating is configured to produce an audible and/or tactile signature when said line of weakness is broken.

The regions to which a varnish or lacquer coating are applied may be equispaced along the line of weakness.

In certain embodiments, the line of weakness may comprise a tear strip. In such embodiments, a tab can then extend from an end of the tear strip that can be grasped by a user to facilitate tearing of the tear strip.

A varnish or lacquered coating may be applied to spaced regions across its entire surface of the packaging.

In some embodiments, each spaced region along the line of weakness may be elongate in shape and extend in a direction perpendicular to the direction in which the tear strip is torn.

In other embodiments, each region along the line of weakness may be chevron shaped, with the apex of the chevron pointing in the direction in which the tear strip is torn.

In any embodiment, the varnish or lacquer coating may be water based and/or UV cured.

The packaging may comprise an overwrap, such as a polymer film. In this embodiment, the packaging may then also comprise a container wrapped in said overwrap with said line of weakness being formed in said overwrap.

According to an embodiment of the invention there is also provided a pack of smoking articles comprising the packaging of the invention.

According to another embodiment of the invention, there is also provided a method of manufacturing packaging that includes a line of weakness that is broken to obtain access to within said packaging. The method includes the application of a varnish or lacquer coating to spaced regions along the length of the line of weakness.

BRIEF DESCRIPTION OF DRAWINGS

Embodiments of the invention will now be described, by way of example only, with reference to the accompanying drawings, in which.

DETAILED DESCRIPTION

Each of the embodiments of the invention will be described with reference to packaging that comprises a container and an overwrap material that extends around and encloses the container, the line of weakness being formed in the overwrap. However, it will be appreciated that embodiments of the invention apply equally to packaging in which the overwrap material extends directly about the article or articles to be packaged, such as a bundle of smoking articles, without the need for an additional container. Furthermore, in other embodiments the line of weakness may be formed in a container that directly surrounds and contains the articles being packaged, without the requirement for an overwrap.

Figure 1:
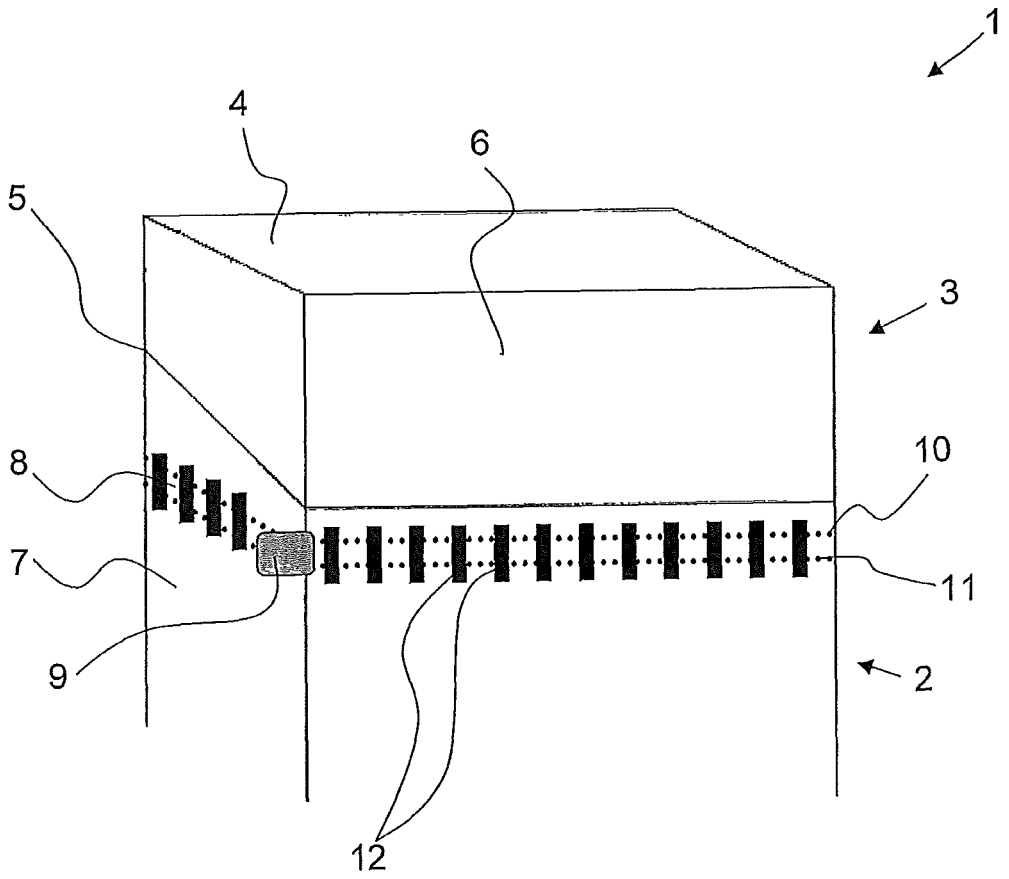
FIG. 1 shows a partial view of packaging according to embodiments of the invention.

Referring to the drawings, FIG. 1 shows a container 1 comprising a body portion 2, a lid portion 3 and a film overwrap 4 with a tear strip 8. In this example, the container 1 is for smoking articles and the lid portion 3 is pivotally attached to the body portion 2 at a hinge 5. The film overwrap 4 comprises an upper section 6 and a lower section 7 that extends over the lid and body portions 2, 3 respectively, and which is joined by the tear strip 8. The tear strip 8 is integrally formed with the container 1 and extends around it. A pull tab 9 is provided at one end and the tear strip is attached to the upper and lower sections 6, 7 by first and second parallel lines of weakness 10, 11.

To open the lid 3 and access the contents of the body 2, the upper section 6 of the overwrap 4 is separated from the lower section 7 to allow the lid portion 3 to freely pivot into its open position. To separate the upper and lower sections 6, 7, the tab 9 is pulled so that the tear strip 8 breaks along the lines of weakness 10, 11 and the tear strip 8 is at least partly removed from the overwrap 4. This separates the upper section 6 of the overwrap 4 from the lower section 7 and enables the upper section 6 to be removed from the container 1.

The overwrap 4 further comprises a plurality of spaced regions 12, extending across the tear strip 8 and attached to both the upper and lower sections 6, 7 of the overwrap 4. These regions 12 are formed from varnish, lacquer or adhesive which are applied to the surface of the overwrap and allowed to cure, so as to form spaced deposits. When the tear strip 8 is torn by pulling the tab 9, the lacquered regions 12, which are brittle when fully cured, are sequentially broken creating an audible ripping or rasping sound, thereby generating an audible signature and providing the person opening the container with a tactile sensation as the lacquered regions 12 break. The user also feels a degree of resistance as each region is reached during tearing. The sound of the audible and tactile signature primarily depends on the size, spacing and thickness of the lacquered regions 12, all of which can be controlled to design a desired audible signature.

It will be appreciated that the embodiment described with reference to FIG. 1 is merely an example of an overwrap 4 on a container 1 for smoking articles, with a body and hinged lid. The overwrap 4, with a tear strip and audible signature, may be easily adapted for other containers, including those with twisting, sliding or push-on lids. It is also possible to integrate the tear strip and lacquered regions onto the container itself, without the need for overwrap. For example, the tear strip may join the lid and body of a container and the lacquered regions may be applied directly to the surface of the container. In this way, the lid and body are immediately separable, or pivotable relative to each other, by removing or partially removing the tear strip from the container which will also break the lacquered regions and create an audible signature. Tins, in particular those for containing snus portions, are often provided with a tear strip that is torn and removed to enable first opening of the tin and embodiments of the invention are also applicable to such tins.

Further embodiments of the invention are described with reference to FIGS. 2 to 9 and which show blanks of the overwrap 4, prior to being folded around a container. The overwrap 4 will most likely be made from a polymer film, such as cellophane, but it is equally possible to make the overwrap from other tearable materials, such as paper.

The marked areas 13, 14 (shown in dashed lines) show where the main front and back faces of the container would be located when the overwrap is in position on the container. The areas in between and adjacent to the marked areas are located on the side faces of the container and the top and bottom parts 15, 16 are then folded over and sealed to fix the overwrap 4 to the container, as was shown in FIG. 1.

The tear strip 8 is shown extending across the overwrap 4 and joining to the upper portion of the overwrap at a first line of weakness 10 and to the lower portion of film at a second line of weakness 11. A pull tab 9 is formed at one end of the tear strip 8 and is positioned so that when the overwrap is folded around the container it is located on an edge of the front face where it is most easily accessible. When manufacturing the overwrap, it is desirable to limit waste film material. For this reason the tab 9 is formed from a cut-out 17 on the opposite side of the overwrap 4 so that adjacent overwraps can be made in series, wasting no intermediate material.

Figure 2:
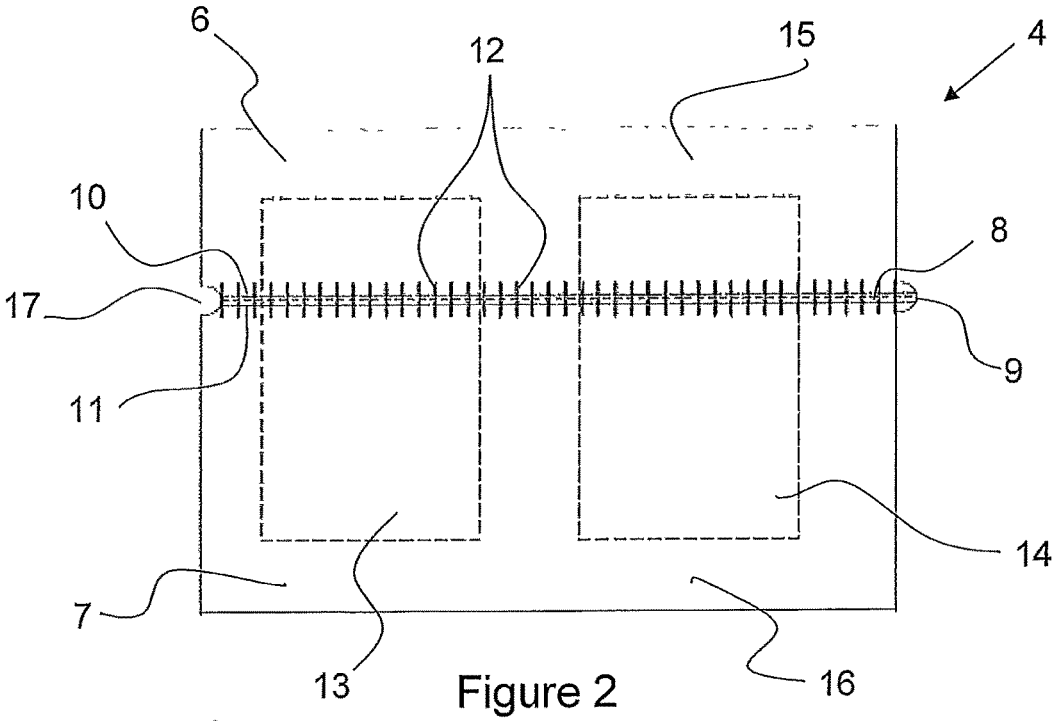
FIG. 2 shows packaging according to a first embodiment of the invention, prior to it being wrapped around a container.

As can be seen in the first embodiment of FIG. 2, a plurality of elongate lacquered regions 12 are arranged perpendicularly to the direction in which the tear strip 8 is torn and first and second lines of weakness 10, 11. The elongate lacquered regions 12 are equispaced along the tear strip 8, although some or all of the regions 12 may be unevenly spaced.

Figure 3:
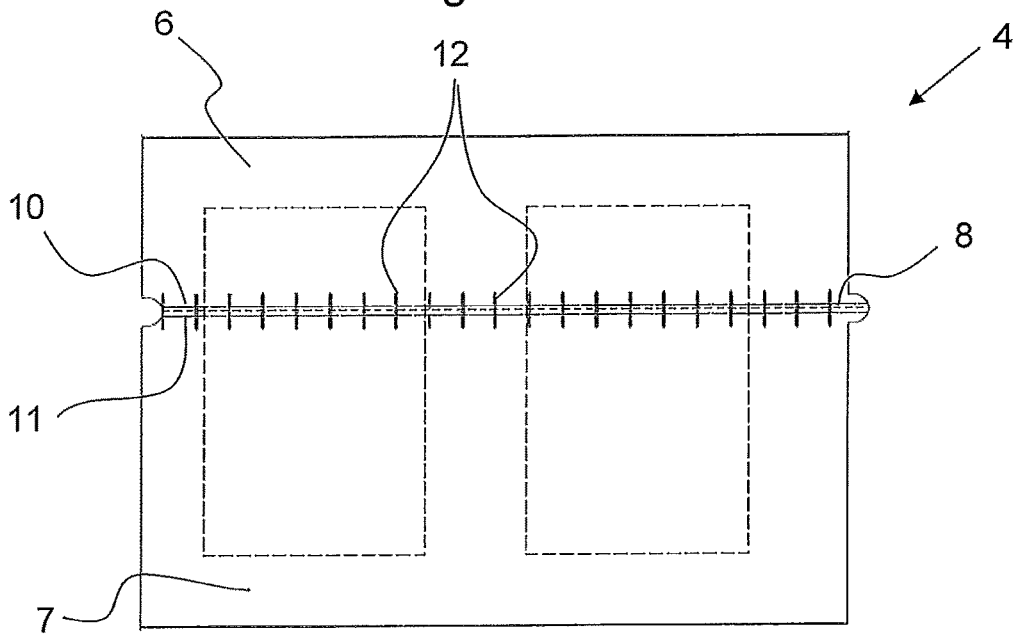
FIG. 3 shows packaging according to a second embodiment of the invention, prior to it being wrapped around a container.

In a second embodiment, shown in FIG. 3, there is more space between the lacquered regions 12 in comparison to the spacing between the lacquered regions 12 of FIG. 2. The increased spacing will create a lower pitch audible signature than the embodiment of FIG. 3, assuming the tear strip 8 is removed at the same speed.

Figure 4:
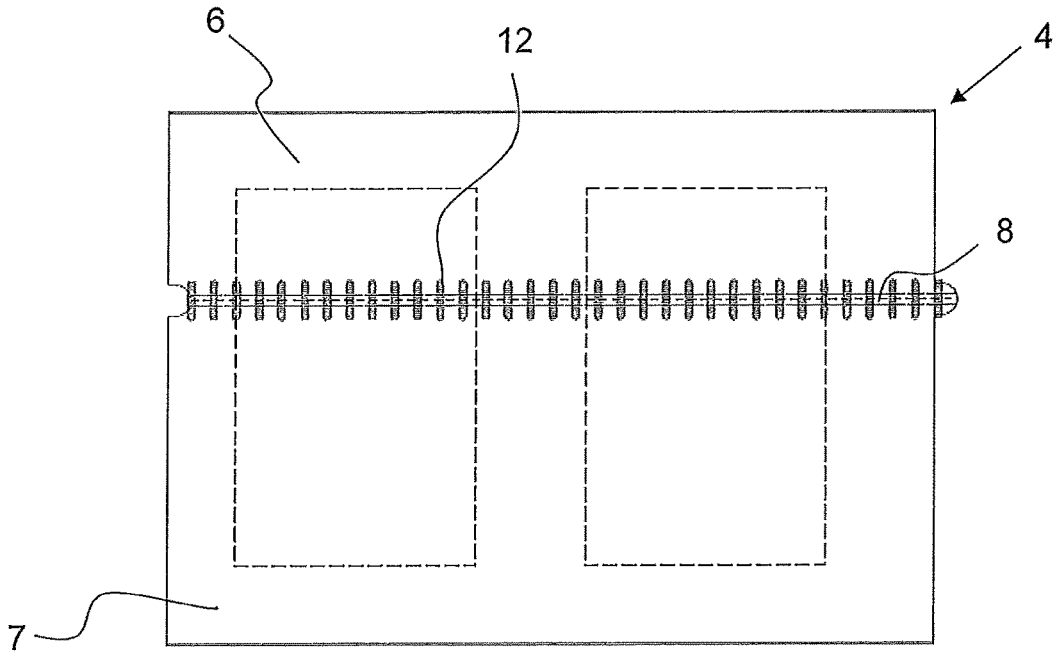
FIG. 4 shows packaging according to a third embodiment of the invention, prior to it being wrapped around a container.

FIG. 4 shows third embodiment with lacquered regions 12 that are larger than those shown in FIGS. 2 and 3. The larger lacquered regions 12 cover a larger area of the surface of the overwrap 4, to create a louder audible signature when they break.

Figure 5:
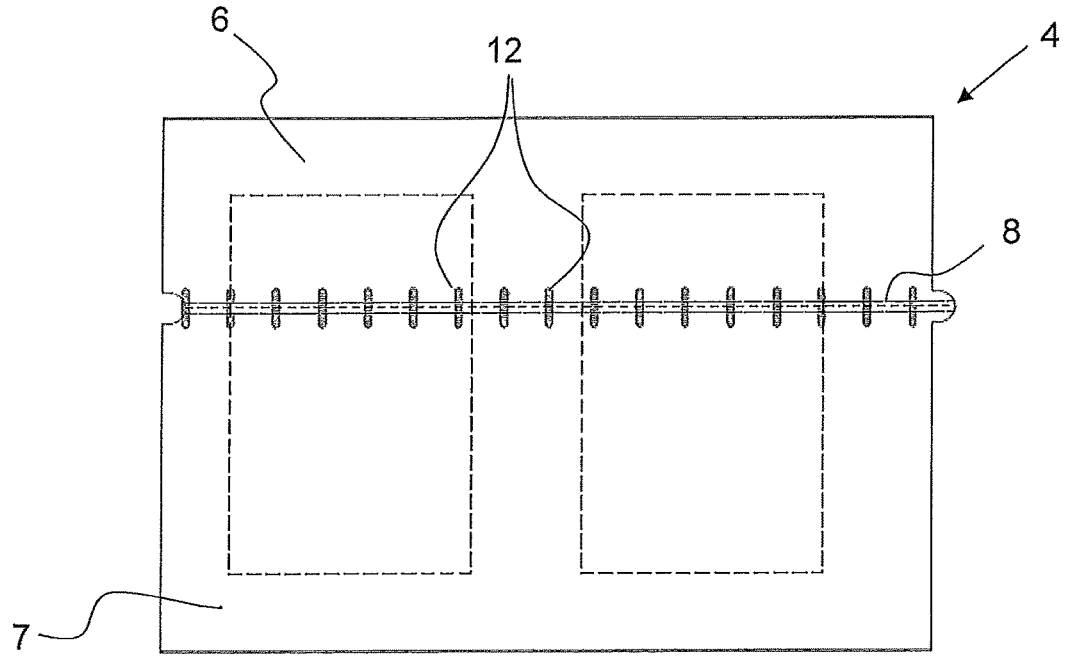
FIG. 5 shows packaging according to a fourth embodiment of the invention, prior to it being wrapped around a container.

FIG. 5 shows a fourth embodiment in which the spacing between the lacquered regions 12 has been increased, to create a lower pitch signature.

Figure 6:
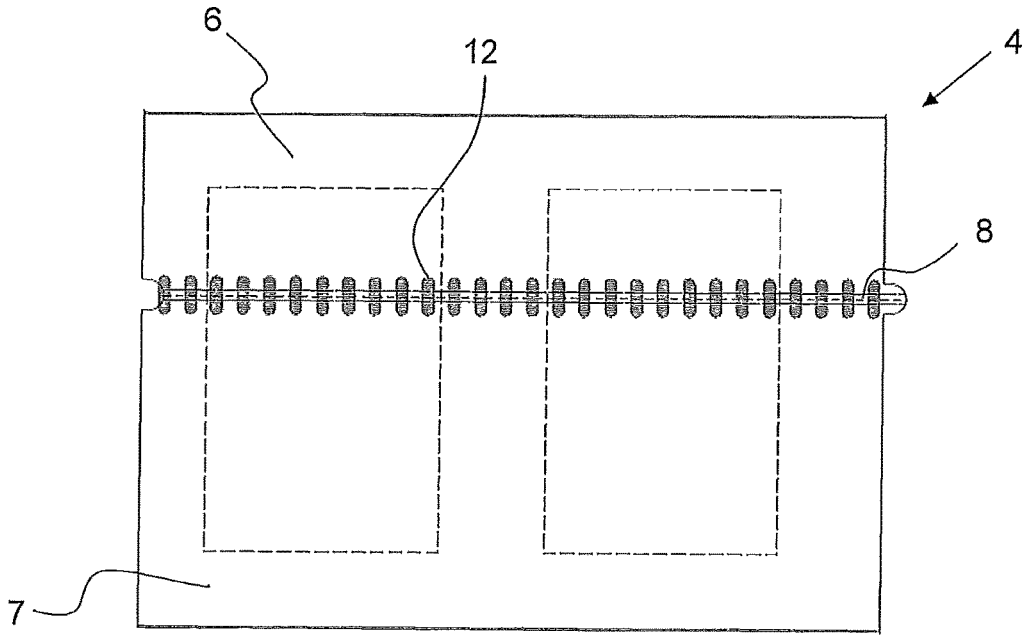
FIG. 6 shows packaging according to a fifth embodiment of the invention, prior to it being wrapped around a container.
Figure 7:
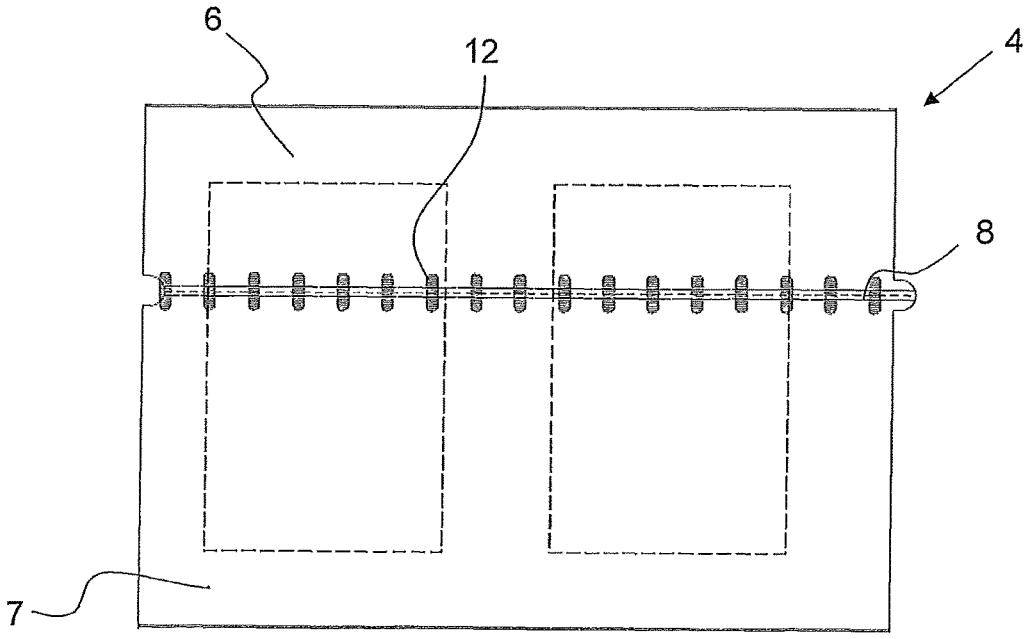
FIG. 7 shows packaging according to a sixth embodiment of the invention, prior to it being wrapped around a container.

FIGS. 6 and 7 show fifth and sixth embodiments in which the overwrap has lacquered regions 12 with different sizes and spacing arrangements between regions 12.

Figure 8:
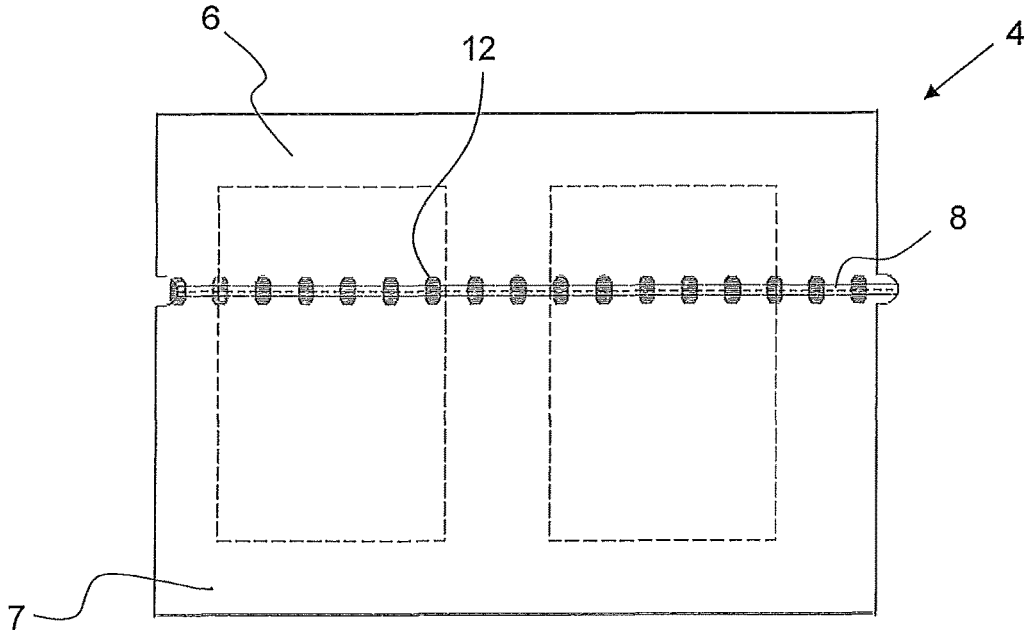
FIG. 8 shows packaging according to a seventh embodiment of the invention, prior to it being wrapped around a container.

FIG. 8 shows a seventh embodiment with reduced length lacquered regions 12. The lacquered regions 12 do not extend as far as the previous embodiments onto the upper and lower portions 6, 7 of the film overwrap 4.

Figure 9:
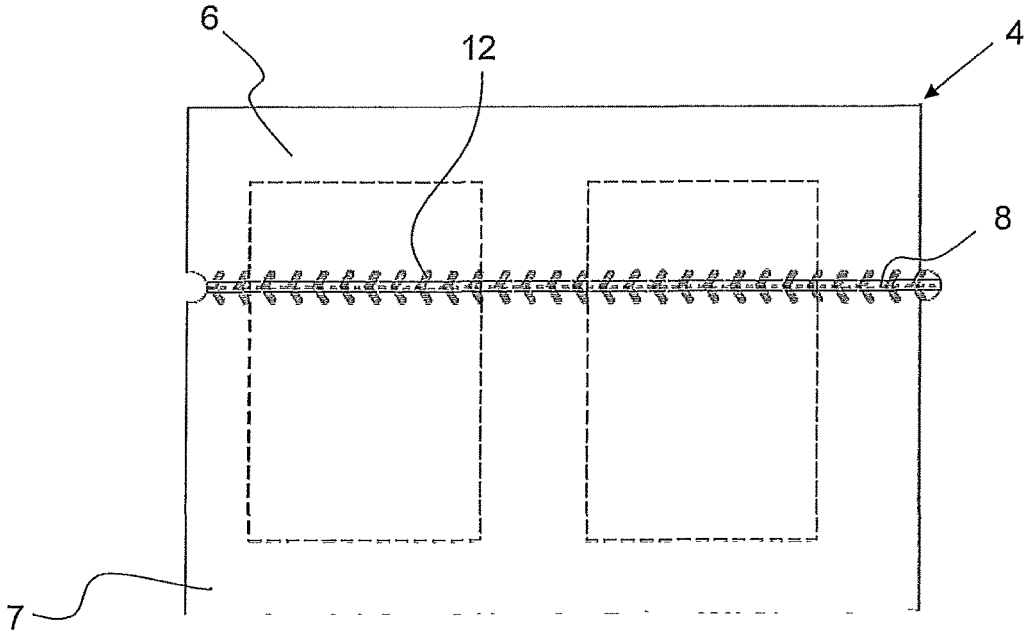
FIG. 9 shows packaging according to a eighth embodiment of the invention, prior to it being wrapped around a container.

FIG. 9 shows an eighth embodiment in which the lacquered regions are chevron shaped that are all arranged equidistantly and point in the same direction. They are positioned so that the point of the chevron is located in the centre of the tear strip 8. The chevron shape will give a different audible signature to the film overwrap 4 and also provides the person opening the container with a visual clue as to the direction in which the tear strip 8 should be pulled.

An additional benefit of the lacquered regions 12 on the overwrap 4 is that as the tab 9 is pulled to remove the tear strip 8 from the overwrap, a person may be able to feel resistance caused by the lacquered regions 12. This resistance would be stepped, i.e. as each region 12 is broken the resistance felt on the tab 9 decreases until the next region 12 is leached. This gives a tactile signature to the film overwrap 4 as the tear strip 8 is pulled.

It will be appreciated that the lacquered regions 12 may be spaced or shaped differently to the embodiments described with reference to FIGS. 2 to 9 without deviating from embodiments of the invention. Indeed, the lacquered regions 12 need not be equispaced for any reason other than to create a constant frequency audible signature. If the spacing of the lacquered regions 12 was varied across the overwrap then audible signatures with varying pitch could be achieved.

Each of the embodiments described with reference to FIGS. 2 to 9 describe the lacquered regions 12 as extending equally onto the upper and lower portions 6, 7 of the overwrap 4 on either side of the tear strip 8. However, it is conceivable to position the lacquered regions 12 in a non-central position, extending further on one side of the tear strip 8 than the other.

The lacquered regions 12 may be formed of lacquer that can be printed onto the surface of the film overwrap 4 and cured. The lacquer may be water based and be cured by heat. Alternatively, the lacquer might be curable by exposure to UV light.

The lacquer, or other material suitable for the lacquered regions 12, may be applied to the overwrap by means of printing, for example gravure printing, although any other printing, painting or laying method may also be suitable.

It is also possible for the lacquer or varnish to be applied to the entire surface of the overwrap. As long as there are unvarnished or unlacquered spaces along the length of the tear strip, it can be applied to the whole or part of the overwrap material in any form.

Although reference is made to a tear strip 8, embodiments of the invention also include packaging that is provided with a single line of weakness, such as a line of perforations. When the overwrap is removed, the perforations will break and the material may simply tear along another, undefined, line at the same time as tearing along the perforated line.

The varnish or lacquer may be applied via a gravure print process using varnish-specific print cylinder(s) prior to being cured using a UV lamp. Examples of varnish that are appropriate for use in embodiments of the invention are available from Siegwerk Druckfarben AG & Co. KGaA. One such ink is known under this companies reference number as: 86-600403-1. However, it will be appreciated that any raised tactile or relief varnish are applicable to the invention. A raised tactile relief varnish is often referred to as a UV varnish as after application to the substrate it must be cured by ultra violet light. The UV light activates the ink to make it raise. A relief varnish is non UV, and is often referred to as HSC (High Solid Content) varnish. A relief varnish does not need curing as it is thicker and inclined to sit proud of the substrate. Although a relief varnish is not suitable for offset printing, both can be applied using a gravure print process and both have a degree of brittleness when cured or dry.

The lacquered regions 12 may be used to give a tactile feeling to the overwrap and have a raised profile so that a user can feel the lacquered regions 12 on the surface of the overwrap to give the overwrap 4 a tactile profile.

The lacquered regions 12 may be coloured to give an aesthetic element to the overwrap 4. Alternatively, they may be transparent and therefore not immediately visible to the user.

In order to address various issues and advance the art, the entirety of this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and teach the claimed principles. It should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and modifications may be made without departing from the scope and/or split of the disclosure. As such, all examples, implementations, and/or embodiments are deemed to be non-limiting throughout this disclosure. Also, no inference should be drawn regarding those embodiments discussed herein relative to those not discussed herein other than it is as such for purposes of reducing space and repetition. Various embodiments may suitably comprise, consist of, or consist essentially of, various combinations of the disclosed elements, components, features, parts, steps, means, etc. Some of the disclosed features, elements, implementation, etc., may be mutually contradictory, in that they cannot be simultaneously present in a single embodiment. Similarly, some features are applicable to one aspect of the disclosure, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, function, features, structural, and/or other aspects of the disclosure are not to be considered limitations on the disclosure as defined by the claims or limitations on equivalents to the claims.

The invention claimed is:

1. A packaging comprising:

an overwrap with a line of weakness defining a tear strip, the line of weakness broken to obtain access to within said packaging, the overwrap including a varnish or lacquer coating applied to extend across the line of weakness at spaced regions along the length of the tear strip, and a container wrapped in said overwrap layer, said line of weakness being formed in said overwrap layer.

2. The packaging according to claim 1, wherein the varnish or lacquer coating is configured to produce an audible and/or tactile signature when said line of weakness is broken.

3. The packaging according to claim 1, wherein the regions to which a varnish or lacquer coating are applied are equispaced along the line of weakness.

4. The packaging according to claim 3, further comprising a tab extending from an end of the tear strip that can be grasped by a user to facilitate tearing of the line of weakness.

5. The packaging according to claim 4, wherein each spaced region along the line of weakness is elongate in shape and extends in a direction perpendicular to the direction in which the tear strip is torn.

6. The packaging according to claim 4, wherein each region along the line of weakness is chevron shaped, with the apex of the chevron pointing in the direction in which the tear strip is torn.

7. The packaging according to claim 1, wherein a varnish or lacquered coating is applied to spaced regions across the entire surface of the overwrap.

8. The packaging according to claim 1, wherein the varnish or lacquer coating is water based and/or UV cured.

9. The packaging according to claim 1, wherein said overwrap layer comprises a polymer film.

10. The packaging of claim 1, wherein the packaging includes a pack of smoking articles.

11. A method of manufacturing packaging, comprising:

providing an overwrap for the packaging, the overwrap including a line of weakness forming a tear strip, the line of weakness broken to obtain access to within said packaging, applying a varnish or lacquer coating to spaced regions along the length of the line of weakness such that the regions of varnish or lacquer coating extend across the line of weakness;

forming a tab at an end of the tear strip which extends outward from the overwrap.

12. An overwrap for a package, comprising:

a line of weakness formed in the overwrap defining an edge of a tear strip;

the line of weakness defining an upper section and a lower section of the overwrap;

a grasping tab extending outward from an end of the tear strip;

a plurality of spaced linear coatings applied substantially perpendicular to the direction of the line of weakness;

wherein each of the linear coatings cross the line of weakness;

the spaced linear coatings positioned on the line of weakness such that when the tear strip breaks the linear coating along the line of weakness when the tear strip is removed;

wherein the upper section of the overwrap removable from the lower section upon removal of the tear strip.

* * * * *